US011210750B2

(12) United States Patent
Kim et al.

(10) Patent No.: US 11,210,750 B2
(45) Date of Patent: Dec. 28, 2021

(54) METHOD AND SYSTEM FOR ENERGY IMPROVEMENT VERIFICATION OF BUILDINGS

(71) Applicant: ELECTRONICS AND TELECOMMUNICATIONS RESEARCH INSTITUTE, Daejeon (KR)

(72) Inventors: Tae Hyung Kim, Daejeon (KR); Hong Soon Nam, Daejeon (KR); Youn Kwae Jeong, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 125 days.

(21) Appl. No.: 16/697,465

(22) Filed: Nov. 27, 2019

(65) Prior Publication Data

US 2020/0175616 A1 Jun. 4, 2020

(30) Foreign Application Priority Data

Nov. 29, 2018 (KR) ..... 10-2018-0151312
May 23, 2019 (KR) ..... 10-2019-0060596

(51) Int. Cl.
*G06Q 50/06* (2012.01)
*F24F 11/63* (2018.01)
*F24F 140/60* (2018.01)

(52) U.S. Cl.
CPC ..... *G06Q 50/06* (2013.01); *F24F 11/63* (2018.01); *F24F 2140/60* (2018.01)

(58) Field of Classification Search
CPC ..... G06Q 50/06; F24F 11/63; F24F 2140/60
See application file for complete search history.

(56) References Cited

U.S. PATENT DOCUMENTS 10,845,791 B2 * 11/2020 Cohen ..... G06Q 50/06
2010/0286937 A1 * 11/2010 Hedley ..... G05B 15/02 702/60
2010/0332373 A1 * 12/2010 Crabtree ..... G06Q 40/04 705/37
2011/0251933 A1 * 10/2011 Egnor ..... G06Q 50/06 705/30
2013/0325377 A1 12/2013 Drees et al.
2014/0107851 A1 * 4/2014 Yoon ..... F24F 11/30 700/291

(Continued)

FOREIGN PATENT DOCUMENTS

KR 10-2009-0058270 A 6/2009
KR 10-2017-0105828 A 9/2017

*Primary Examiner* — Ramesh B Patel
(74) *Attorney, Agent, or Firm* — LRK Patent Law Firm

(57) ABSTRACT

A method and system for energy improvement verification of buildings. An energy improvement learning method includes receiving building characteristic information related to an existing building constructed in the past and a diagnosis result of energy diagnosis performed based on the building characteristic information, receiving a result of renovating the existing building using energy saving schemes suitable for the diagnosis result, and generating an energy improvement learning model for the existing building by learning the building characteristic information and the renovation result.

12 Claims, 8 Drawing Sheets

(56) References Cited

U.S. PATENT DOCUMENTS

| | | | | |
|---|---|---|---|---|
| 2014/0303796 | A1* | 10/2014 | Jeong | G06Q 50/06 700/291 |
| 2016/0306906 | A1* | 10/2016 | McBrearty | H02S 50/10 |
| 2017/0364051 | A1 | 12/2017 | Kang et al. | |
| 2018/0188704 | A1* | 7/2018 | Cella | G05B 19/4183 |
| 2018/0307989 | A1 | 10/2018 | Nam | |
| 2019/0041081 | A1 | 2/2019 | Zeifman | |
| 2019/0253861 | A1* | 8/2019 | Horelik | H04W 76/50 |
| 2021/0055750 | A1* | 2/2021 | Noziere | G05D 23/1917 |

* cited by examiner

*M.E: Monthly energy, 1x12 matrix

*n, the number of input variables, differs depending on system type

*M.E: Monthly energy, 1x12 matrix

*n, the number of input variables, differs depending on system type

METHOD AND SYSTEM FOR ENERGY IMPROVEMENT VERIFICATION OF BUILDINGS

CROSS-REFERENCE TO RELATED APPLICATION(S)

This application claims the priority benefit of Korean Patent Application No. 10-2018-0151312, filed on Nov. 29, 2018, and Korean Patent Application No. 10-2019-0060596, filed on May 23, 2019, in the Korean Intellectual Property Office, the disclosures of which are incorporated herein by reference for all purposes.

BACKGROUND

1. Field of the Invention

One or more example embodiments relate to a method and system for energy improvement verification of buildings, and more particularly, to technology for systematizing a series of operations corresponding to energy diagnosis and evaluation of buildings performed by building energy diagnosis enterprises or experts, and integrally managing data input and output for each operation, and thereby pre-verifying improvement proposals suitable for characteristics of a building of a user and the economic efficiency and energy saving effects thus achieved.

2. Description of Related Art

In general, energy performance diagnosis and evaluation of buildings is performed by qualified and specialized organization or manpower, which incurs a plenty of economic and time costs. Further, different results may be obtained for similar buildings, depending on the level and the opinion of an expert, and with respect to energy saving schemes derived therethrough, different items may be actually reflected in renovation and remodeling of buildings depending on conditions (cost, schedule, and personal situation) of a user, that is, a building manager.

There is no method of integrally managing data with respect to initial diagnosis results and follow-up results of buildings by associating energy performance diagnosis and evaluation results of buildings after the renovation and remodeling of the buildings is completed, and statistically utilizing or applying the integrally managed data.

SUMMARY

An aspect provides a method and system that may reduce economic and time costs incurred during diagnosis and evaluation for saving the energy consumption of existing buildings, and systematically divide operations to be performed therefor, and integrally manage input and output data for the operations.

Another aspect also provides a method and system that may check and verify the results of energy diagnosis and renovation with respect to a target building through an energy improvement learning model generated by utilizing integrally managed data.

According to an aspect, there is provided an energy improvement learning method including receiving building characteristic information related to an existing building constructed in the past and a diagnosis result of energy diagnosis performed based on the building characteristic information, receiving a result of renovating the existing building using energy saving schemes suitable for the diagnosis result, and generating an energy improvement learning model for the existing building by learning the building characteristic information and the renovation result.

The energy improvement learning model may be configured to provide statistical data related to an energy consumption of a target building requiring energy efficiency improvement based on building characteristic information related to the target building.

The energy improvement learning model may be configured to derive energy saving schemes for the target building in descending order of energy saving effects based on the statistical data.

The energy improvement learning model may be configured to derive energy saving rates corresponding to opportunity costs of renovation using the energy saving schemes for the target building.

The building characteristic information may include at least one of construction information, facility information, an energy consumption, environment information, weather information, and occupant behavior pattern information related to the existing building.

The diagnosis result may include at least one of a construction state, a facility state, an energy consumption level, and an energy saving scheme corresponding to the building characteristic information.

The renovation result may include at least one of a renovation item with respect to the existing building, an economic cost with respect to the renovation item, an energy saving rate with respect to the existing building after the renovation, and an additional energy saving scheme.

According to an aspect, there is provided an energy improvement verification method including receiving building characteristic information related to a target building requiring energy efficiency improvement from a user, verifying a renovation result by analyzing the received building characteristic information using an energy improvement learning model for an existing building, and providing the user with the verified renovation result, wherein the energy improvement learning model may be generated by learning the building characteristic information, a diagnosis result of energy diagnosis performed based on the building characteristic information, and a result of renovating the existing building using energy saving schemes suitable for the diagnosis result.

The verifying may include estimating statistical data related to an energy consumption of the target building by analyzing the received building characteristic information, deriving energy saving schemes for the target building based on the estimated statistical data, and verifying a renovation result corresponding to an energy saving scheme selected from the derived energy saving schemes.

The deriving may include deriving the energy saving schemes for the target building in descending order of energy saving effects based on the statistical data.

The verifying may include deriving energy saving rates corresponding to opportunity costs of renovation using the energy saving schemes for the target building.

According to an aspect, there is provided an energy improvement verification system including an energy improvement learning apparatus configured to generate an energy improvement learning model for an existing building constructed in the past, based on building characteristic information related to the existing building, a diagnosis result of energy diagnosis performed based on the building characteristic information, and a result of renovating the existing building using energy saving schemes suitable for the diagnosis result, and an energy improvement verification apparatus configured to verify a renovation result by analyzing building characteristic information related to a target building requiring energy efficiency improvement using the generated energy improvement learning model, the building characteristic information received from a user.

The energy improvement verification apparatus may be configured to estimate statistical data related to an energy consumption of the target building by analyzing the received building characteristic information, derive energy saving schemes for the target building based on the estimated statistical data, and verify a renovation result corresponding to an energy saving scheme selected from the derived energy saving schemes.

The energy improvement verification apparatus may be configured to derive the energy saving schemes for the target building in descending order of energy saving effects based on the statistical data.

The energy improvement verification apparatus may be configured to derive energy saving rates corresponding to opportunity costs of renovation using the energy saving schemes for the target building.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION OF THE INVENTION

Figure 1:
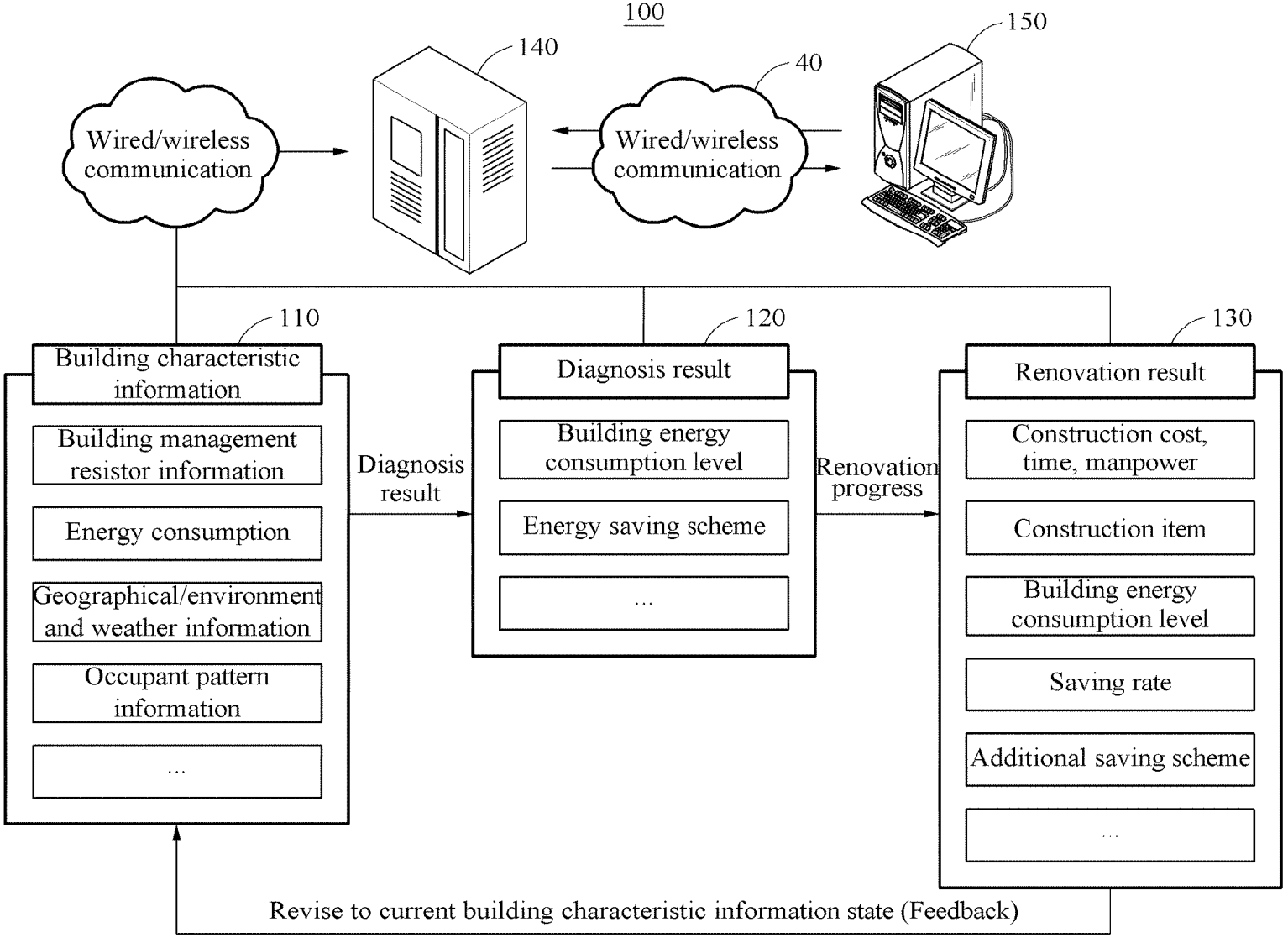
FIG. 1 illustrates an energy improvement verification system for buildings according to an example embodiment.

Hereinafter, some example embodiments will be described in detail with reference to the accompanying drawings. However, various alterations and modifications may be made to the example embodiments. Here, the example embodiments are not construed as limited to the disclosure and should be understood to include all changes, equivalents, and replacements within the idea and the technical scope of the disclosure.

The terminology used herein is for the purpose of describing particular example embodiments only and is not to be limiting of the example embodiments. As used herein, the singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the example embodiments with reference to the accompanying drawings, like reference numerals refer to like constituent elements and a repeated description related thereto will be omitted. In the description of example embodiments, detailed description of well-known related structures or functions will be omitted when it is deemed that such description will cause ambiguous interpretation of the present disclosure.

FIG. 1 illustrates an energy improvement verification system for buildings according to an example embodiment.

First, a qualified expert may actually offline perform an energy diagnosis and evaluation process for energy consumption saving of an existing building as follows.

In detail, the expert may (1) collect building characteristic information related to the existing building requiring energy consumption saving, and (ii) derive a diagnosis result with respect to the energy consumption of the existing building by performing an energy diagnosis based on the collected building characteristic information. After that, the expert may (iii) obtain a renovation result by performing actual renovation or remodeling with respect to the existing building using energy saving schemes corresponding to the diagnosis result, and (iv) acquire an energy improvement effect with respect to the existing building through the renovation by revising (feeding back) the building characteristic information of the existing building based on the obtained renovation result.

However, many qualified experts are needed to acquire such energy improvement effects with respect to existing buildings, which incurs a plenty of economic and time costs, and different results may be obtained even for similar buildings depending on the level and the opinion of an expert.

To overcome such disadvantages, an energy improvement verification system 100 may integrally manage data related to the plurality of operations performed by the expert to acquire the energy improvement effects for buildings and learn the integrally managed data through a machine learning model, and thereby derive a low-cost high-reliability energy saving scheme for buildings.

For this, referring to FIG. 1, the energy improvement verification system 100 may include an energy improvement learning apparatus 140 and an energy improvement verification apparatus 150. In this example, the energy improvement learning apparatus 140 and the energy improvement verification apparatus 150 may be provided in the same equipment or at different locations, and transmit and receive data through wired and wireless communication.

The energy improvement learning apparatus 140 may receive, through wired and wireless communication, a variety of information generated during an energy diagnosis and evaluation process performed actually offline by the expert. The variety of information may include, for example, statistical data corresponding to building characteristic information 110, a diagnosis result 120 and a renovation result 130. The energy improvement learning apparatus 140 may generate an energy improvement learning model corresponding to an energy saving scheme and building characteristics by learning the received statistical data through the machine learning model.

The energy improvement verification apparatus 150 may check and verify in advance the renovation result without actually performing renovation or remodeling, by analyzing building characteristic information related to a target building requiring energy efficiency improvement, the building characteristic information received from a user, using the energy improvement learning model generated by the energy improvement learning apparatus 140.

Figure 2:
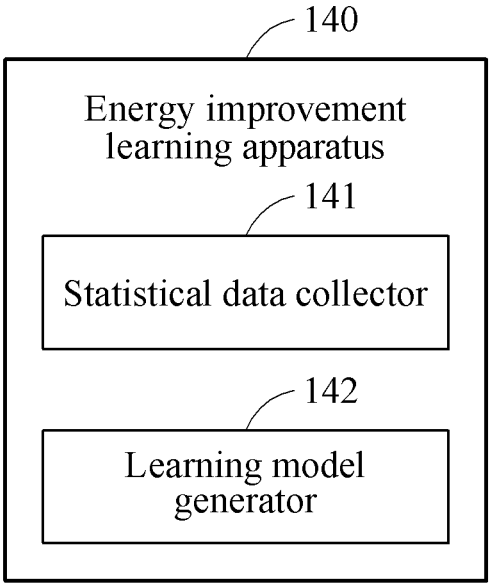
FIG. 2 illustrates an energy improvement learning apparatus for buildings according to an example embodiment.

FIG. 2 illustrates an energy improvement learning apparatus for buildings according to an example embodiment.

Referring to FIG. 2, the energy improvement learning apparatus 140 may include a statistical data collector 141 and a learning model generator 142. In detail, the statistical data collector 141 may receive, through wired and wireless communication, a variety of information generated during an energy diagnosis and evaluation process performed actually offline by an expert. The variety of information may include, for example, the statistical data corresponding to the building characteristic information 110, the diagnosis result 120 and the renovation result 130.

In this example, the building characteristic information 110 may be data necessary for performing an energy performance diagnosis and evaluation with respect to an existing building requiring energy consumption saving. In detail, the building characteristic information 110 may include construction information, facility information, energy consumption information (energy consumption), geographical information, surrounding environment information, and weather information of the existing building and, more particularly, include occupant behavior pattern information.

The building characteristic information 110 is not limited to the examples described above, and may include all data required for a typical energy diagnosis-specialized organization or expert that performs an energy performance diagnosis and evaluation for buildings.

An energy diagnosis may be performed by the specialized organization or expert capable of performing an energy performance diagnosis and evaluation for buildings, and an energy diagnosis and evaluation method for buildings may include a process following the procedure specified in international and domestic standard guidelines.

The diagnosis result 120 may be a result of the energy diagnosis performed by the specialized organization or expert, and may include an energy consumption level, a construction state, a facility state, and efficiency diagnosis results of a building according to the building characteristic information. Further, the diagnosis result 120 may include an energy saving scheme including a building and facility renovation/remodeling scheme or renovation/remodeling items for saving the energy consumption of the building through the result obtained through the energy diagnosis.

A renovation may include a process of performing an actual construction through the specialized organization or expert with respect to an energy saving scheme finally selected by decision making corresponding to conditions of the user, among the energy saving schemes derived based on the diagnosis result 120.

The conditions of the user for the renovation may include a construction cost or a construction period of a building manager or a building owner, or other elements required for decision making to perform the construction.

The renovation result 130 may include information related to building and facility renovation/remodeling items, a construction time, and economic cost for provided manpower. Further, the renovation result 130 may additionally include energy saving rates and the results of additional saving schemes by newly updating the diagnosis result 120 through feedback of the building characteristic information 110 after a construction with respect to the renovation/remodeling items is completed, to current building characteristic information.

The learning model generator 142 may generate an energy improvement learning model corresponding to the energy saving scheme and building characteristics by learning, through a machine learning model, the variety of information collected by the statistical data collector 141, that is, the statistical data corresponding to the building characteristic information 110, the diagnosis result 120 and the renovation result 130.

Figure 3:
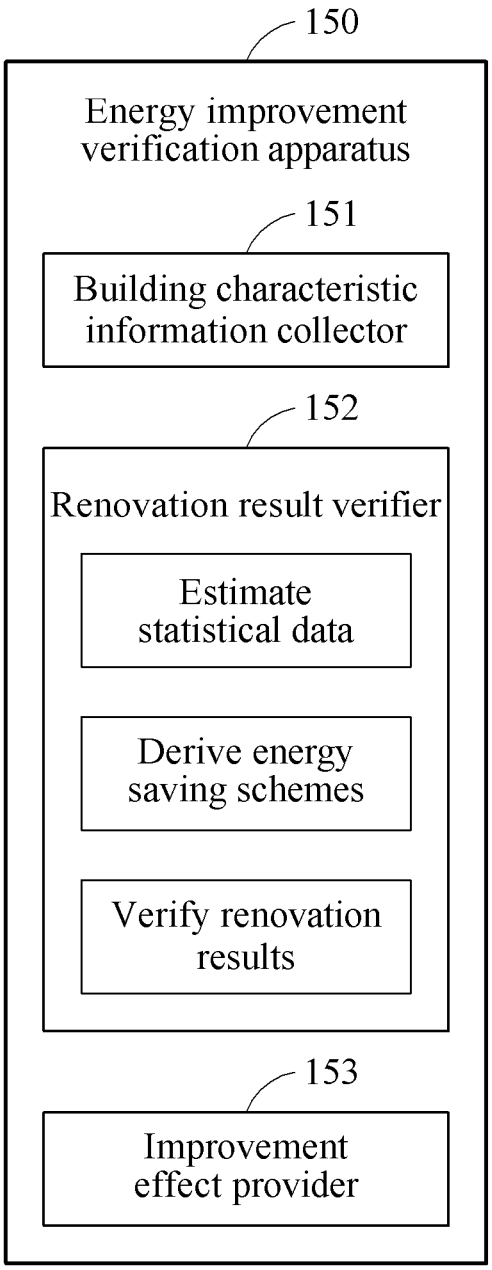
FIG. 3 illustrates an energy improvement verification apparatus for buildings according to an example embodiment.

FIG. 3 illustrates an energy improvement verification apparatus for buildings according to an example embodiment.

Referring to FIG. 3, the energy improvement verification apparatus 150 may include a building characteristic information collector 151, a renovation result verifier 152 and an improvement effect provider 153. In detail, the building characteristic information collector 151 may receive building characteristic information related to a target building requiring energy efficiency improvement through a user interface.

After that, the renovation result verifier 152 may estimate a diagnosis result with respect to an energy consumption of the target building by analyzing the received building characteristic information using the energy improvement learning model generated by the energy improvement learning apparatus 140. In this example, the diagnosis result may be provided in the form of statistical data of an energy consumption level, a construction state, a facility state, and efficiency diagnosis results of the target building.

The renovation result verifier 152 may derive energy saving schemes for the target building based on the statistical data related to the energy consumption. In this example, the renovation result verifier 152 may derive the energy saving schemes for the target building in descending order of energy saving effects based on the statistical data related to the energy consumption of the target building.

Concurrently, the renovation result verifier 152 may derive energy saving rates corresponding to renovation opportunity costs according to the energy saving schemes for the target building.

When one or more energy saving schemes are selected from among the derived energy saving schemes for the target building, the renovation result verifier 152 may verify renovation results corresponding to the selected energy saving schemes.

The improvement effect provider 153 may provide the user with the renovation result with respect to the energy saving schemes verified by the renovation result verifier 152.

That is, when building characteristic information related to the target building is received from the user, the energy improvement verification apparatus 150 may verify statistical data related to the energy consumption of the target building by analyzing the received building characteristic information through an energy improvement learning model, and derive energy saving schemes suitable for the target building through the verified statistical data related to the energy consumption.

Further, the energy improvement verification apparatus 150 may check and verify in advance and provide a renovation result corresponding to an energy saving scheme statistically through a machine learning model, when the energy saving scheme is selected from the derived energy saving schemes by the user, and thereby provide a low-cost high-reliability method of verifying energy improvement effects.

Figure 4:
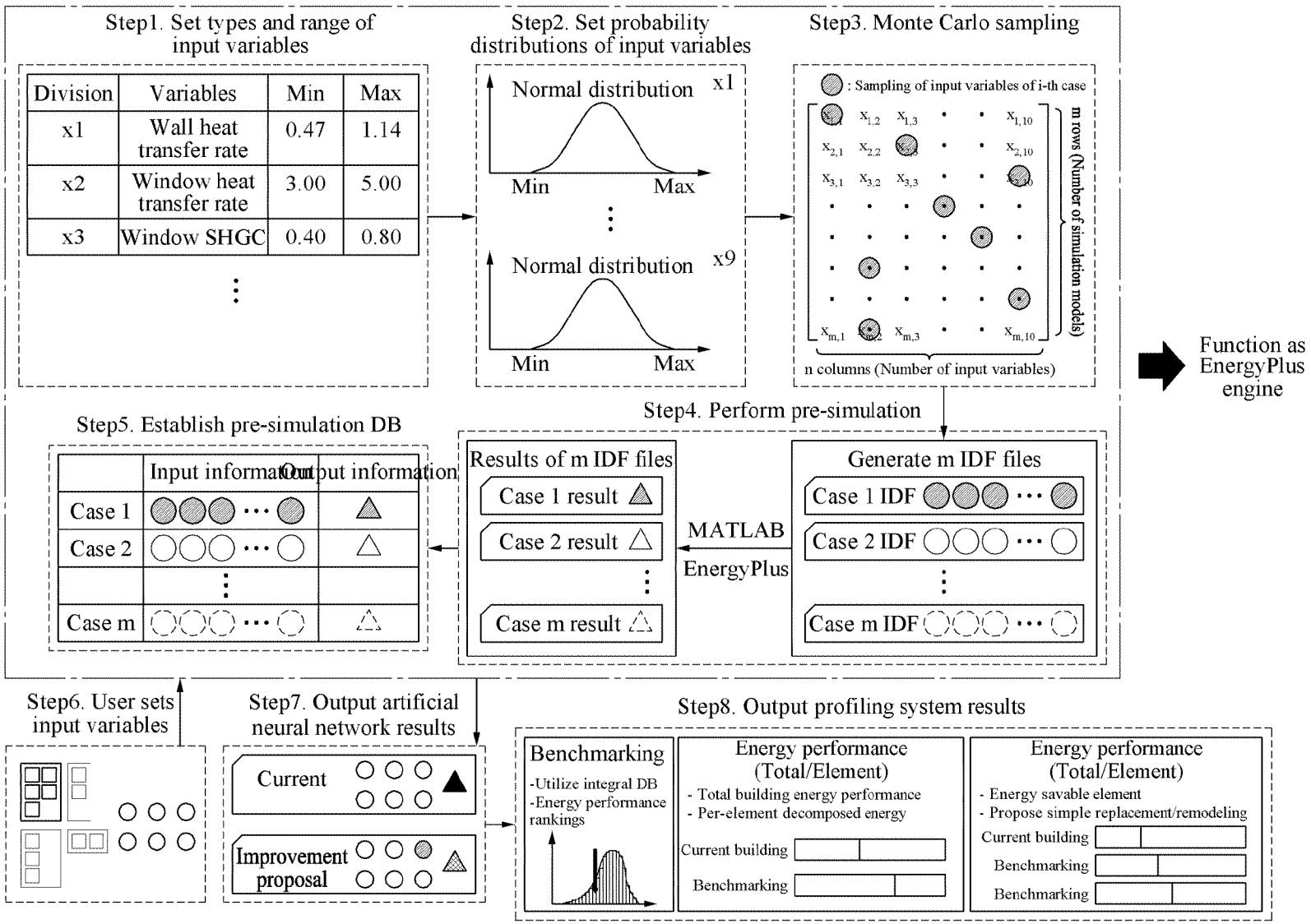
FIG. 4 illustrates a concept of a building energy profiling system (BEPS) including a standard model based energy improvement learning apparatus and an energy improvement verification apparatus according to an example embodiment.

FIG. 4 illustrates a concept of a building energy profiling system (BEPS) including a standard model based energy improvement learning apparatus and an energy improvement verification apparatus according to an example embodiment.

The BEPS may include the energy improvement learning apparatus 140 and the energy improvement verification apparatus 150, and may be a profiling based BEPS. The BEPS may output an energy profiling result of buildings using an artificial neural network model having learned an EnergyPlus based pre-simulation database.

In detail, the BEPS may set the types and range of input variables required for a building energy simulation to define a standard model of existing buildings (Step 1), set probability distributions with respect to the input variables (Step 2), perform Monte Carlo sampling based on the probability distributions (Step 3), and then perform a pre-simulation by applying the samples to an EnergyPlus model (Step 4). The BEPS may store the inputs used for the pre-simulation and corresponding results in the form of a database (Step 5), and utilize the stored database as training data for the artificial neural network model.

If a user inputs input conditions into the trained artificial neural network model (Step 6), the BEPS may output a corresponding result (Step 7) and provide a building energy profiling result to the user (Step 8). That is, the user may conveniently and quickly derive the building energy profiling result through a few input variables using the BEPS.

<1. Standard Model>

The standard model defined by the BEPS may be a model for expressing the energy performance of existing buildings, and use the following input variables.

- Building outline: building location, year of completion
- Building shape: gross floor area, number of floors, window area ratio, length-to-width ratio, azimuth
- Building management: heating start time, heating end time, heating setting temperature, cooling start time, cooling end time, cooling setting temperature, air supply volume
- Construction property: wall heat transfer rate, window heat transfer rate, window SHGC
- Indoor heating: room density, room thermal value, lighting thermal density, device thermal density, infiltration
- Air conditioner: Main type (VAV, CAV, EHP), Main fan efficiency, Main option (outdoor air cooling, heat exchanger), cooling COP (if Main type is EHP), heating COP (if Main type is EHP), Sub-type (FCU, EHP), Sub-fan efficiency, cooling COP (if Sub-type is EHP), heating COP (if Sub-type is EHP)
- Cooling plant: type (compression refrigerator, absorption refrigerator (heat source: gas, district cooling), hot and cold water dispenser), cooling COP, cold water setting temperature, coolant setting temperature
- Heating plant: type (gas boiler, district heating), efficiency, hot water setting temperature
- Hot water supply plant: type (gas boiler, district heating), hot water supply setting temperature Further, the output types derived by the standard model are as follows.

- Monthly cooling energy consumption (heat source: electricity)
- Monthly cooling energy consumption (heat source: gas)
- Monthly cooling energy consumption (heat source: district cooling)
- Monthly cooling pump energy consumption (heat source: gas)
- Monthly gas energy consumption (heat source: electricity)
- Monthly gas energy consumption (heat source: gas)
- Monthly gas energy consumption (heat source: district cooling)
- Monthly gas pump energy consumption (heat source: gas)
- Monthly hot water supply energy consumption (heat source: gas)
- Monthly hot water supply energy consumption (heat source: district heating)
- Monthly lighting energy consumption (heat source: electricity)
- Monthly ventilation energy consumption (heat source: electricity)
- Monthly EHP cooling energy consumption (heat source: electricity)
- Monthly EHP heating energy consumption (heat source: electricity)

<2. Monte Carlo Sampling>

The BEPS may generate simulation cases through the standard model, and use the Monte Carlo sampling technique to dramatically reduce the number of simulation cases. The types of input variables applied to the Monte Carlo sampling may be the same as those of the input variables of the standard model.

Further, the types of output variables of Monte Carlo sampling may be the same as those of the input variables. Here, a plurality of results may be derived for each input variable through Monte Carlo sampling, and the number may vary depending on a setting condition in a process of using an algorithm.

For example, the BEPS may sample the input variables using Latin hypercube sampling, among Monte Carlo Sampling simulation techniques. Sampling may be implemented through a built-in function 'lhsnorm' in a Matlab platform, and inputs of the function may be minimum and maximum values of input variables and a sampling count. In an example, the BEPS may derive a total of 86,000 samples by performing Monte Carlo sampling 1,000 times per each system combination, with respect to 86 system combinations supported by the present system.

<3. Pre-Simulation>

The types of input variables and output variables used for pre-simulation of the BEPS may be the same as the types of input variables and output variables applied to the standard model and the Monte Carlo sampling. In this example, the values of input variables of each case derived using Monte Carlo sampling may be applied to the pre-simulation, and the values of output variables in the pre-simulation may be derived through computation of an EnergyPlus engine.

To generate EnergyPlus input files for performing the pre-simulation, the BEPS may produce a reference model, and a sampling result may implement Matlab codes to correct information of the reference model. The EnergyPlus input files may be converted into text (.txt) files, and read, written, and modified in the Matlab platform. Thus, the Matlab codes may be implemented to retrieve the EnergyPlus input files of the reference model and correct the values of input variables in the input files. Through this, the BEPS may automatically generate 86,000 EnergyPlus input files with the 86,000 Monte Carlo samples.

<4. Artificial Neural Network Model>

The types of input variables used for the artificial neural network model of the BEPS may be the same as the types of input variables applied to the standard model, the Monte Carlo sampling, and the pre-simulation. Here, the values of input variables used during a process of training the artificial neural network model may be the same as the values of the Monte Carlo sampling, and the values of input variables used for the trained artificial neural network model may be input and set by the user in freedom within the range of minimum and maximum values.

The types of output variables used for the artificial neural network model of the BEPS may be as follows.

- Cooling energy consumption (heat source: electricity)
- Cooling energy consumption (heat source: gas)
- Cooling energy consumption (heat source: district cooling)
- Cooling pump energy consumption (heat source: gas)
- Gas energy consumption (heat source: electricity)
- Gas energy consumption (heat source: gas)
- Gas energy consumption (heat source: district cooling)
- Gas pump energy consumption (heat source: gas)
- Hot water supply energy consumption (heat source: gas)
- Hot water supply energy consumption (heat source: district heating)
- Lighting energy consumption (heat source: electricity)
- Ventilation energy consumption (heat source: electricity)
- EHP cooling energy consumption (heat source: electricity)
- EHP heating energy consumption (heat source: electricity)

Figure 5A:
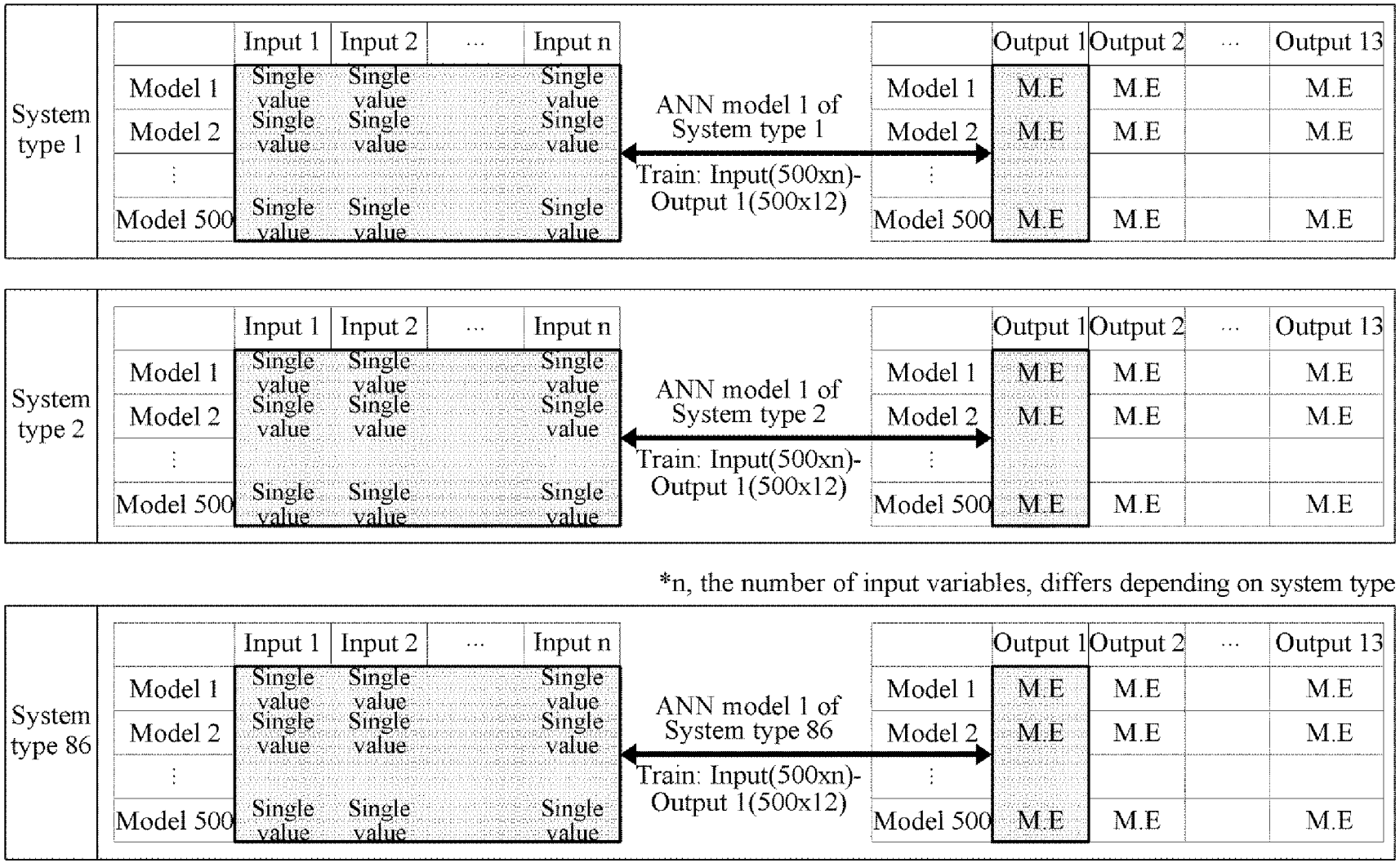
FIGS. 5A through 5C illustrate a process of training an artificial neural network model according to an example embodiment.
Figure 5B:
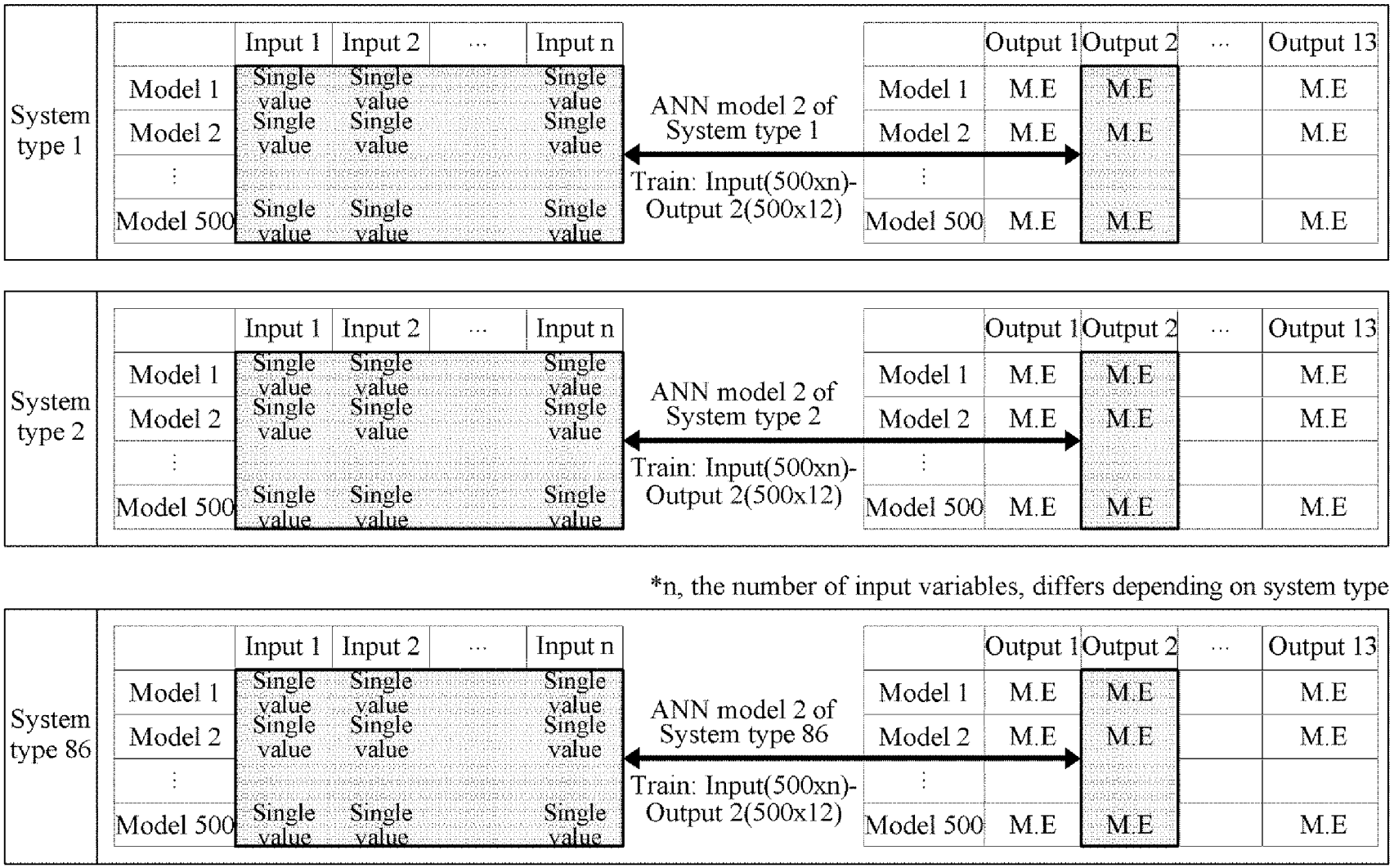
Figure 5C:
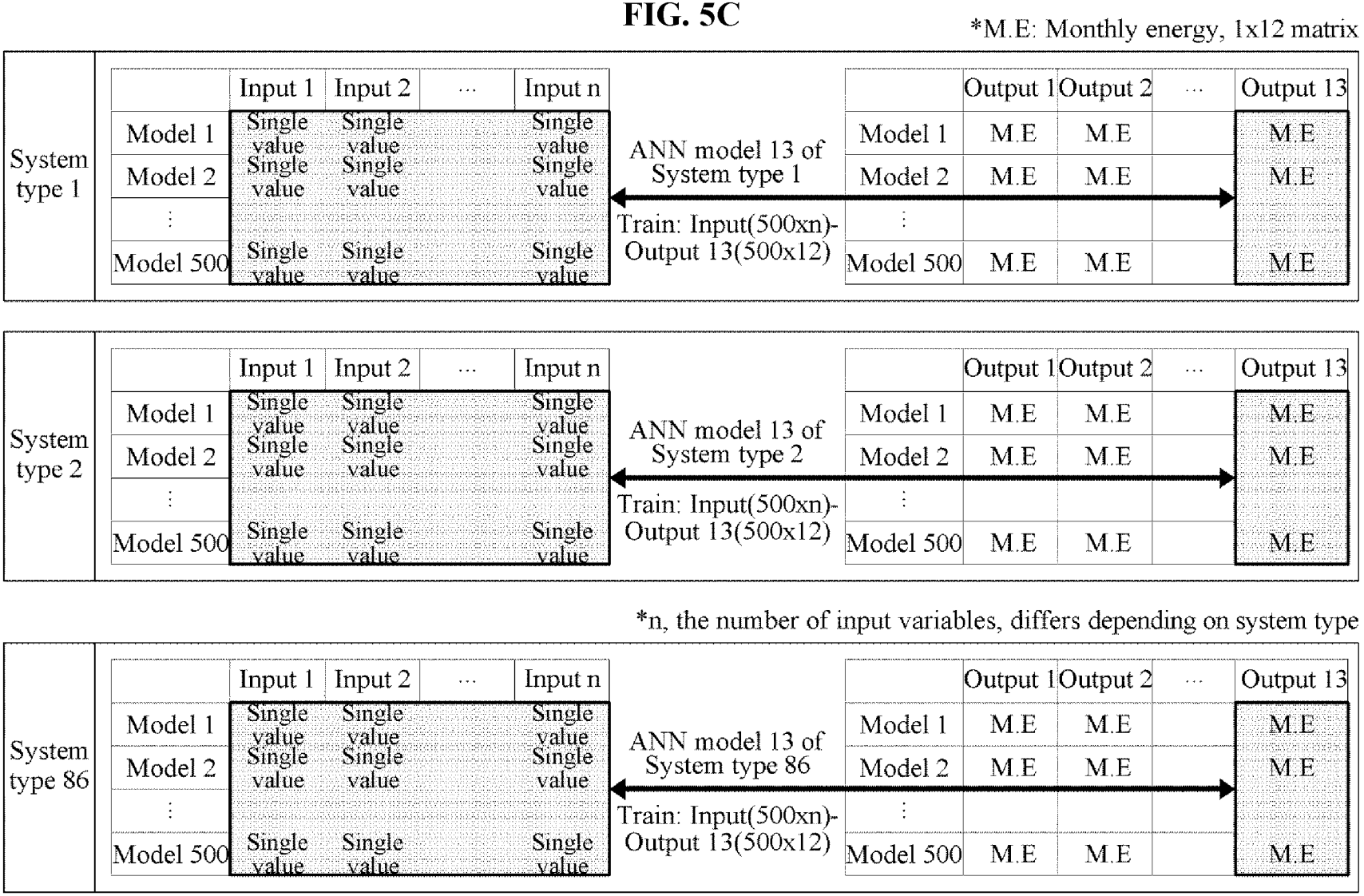
Figure 6:
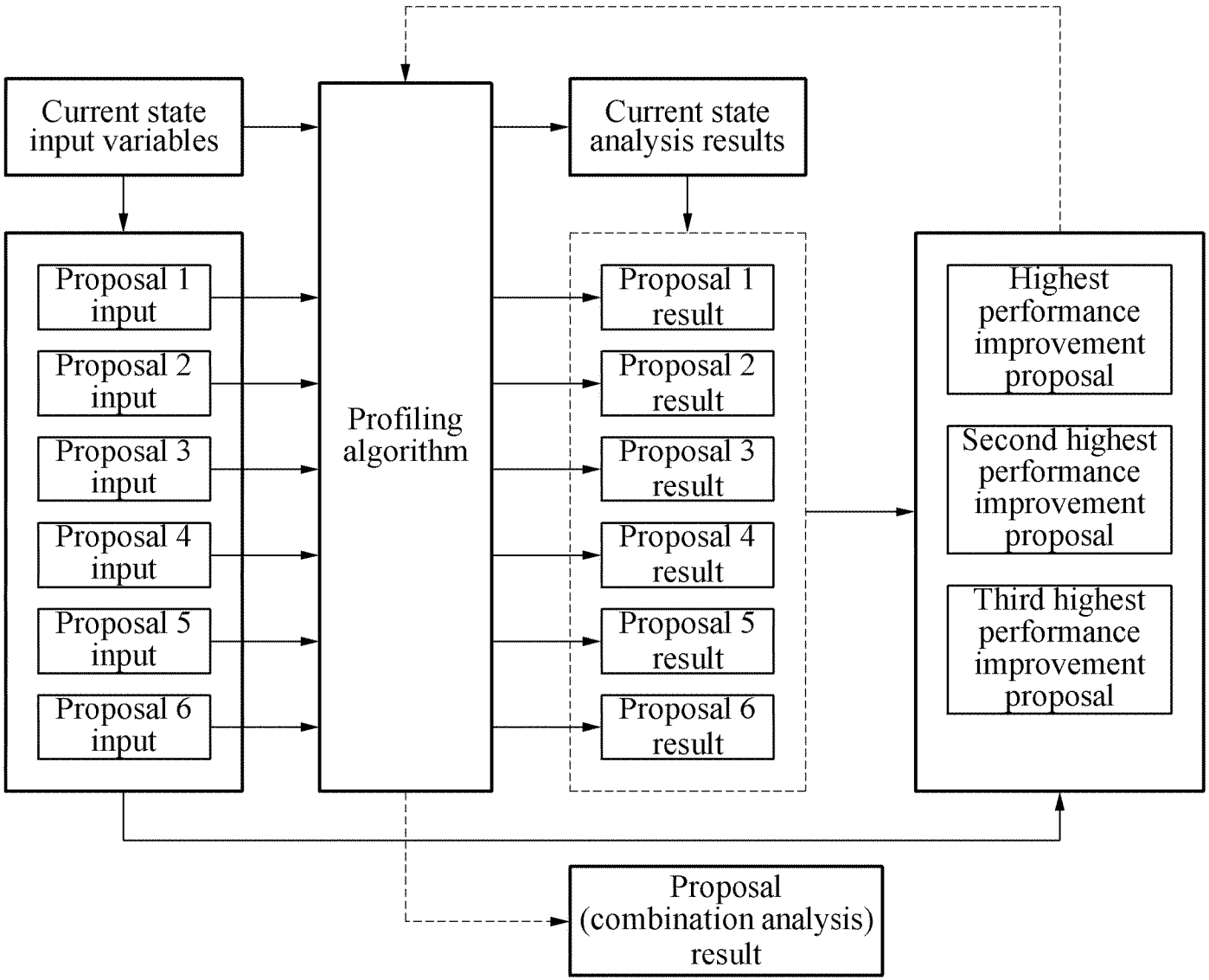
FIG. 6 illustrates an energy performance improvement proposal automatic analysis algorithm according to an example embodiment.

The artificial neural network model of the BEPS provided herein may be trained with respect to outputs of monthly energy consumption, while the inputs with respect to the 86 system combinations are fixed as shown in FIG. 5. In this example, the inputs may be the values of input variables (applied to the pre-simulation) obtained using the Monte Carlo sampling, and the outputs may be the results of pre-simulation.

Meanwhile, the process of training the artificial neural network model may be an optimization problem for determining parameter values to minimize differences between training data and values predicted by the model. A Bayesian regularization method with excellent generalization performance may be used as a training algorithm. To compensate for a convergence on a local optimum, the BEPS may determine a parameter value with the most excellent prediction performance while repeating the process of training each model 10 times, to be an optimum. That is, the artificial neural network model coefficient of the BEPS may finally include a result of the optimum derived through the above procedure.

The Table 1 below shows a result of comparing outputs of the artificial neural network model and outputs of EnergyPlus for verifying the prediction performance of the developed artificial neural network model, which teaches that the BEPS has been developed to a level complying with the mean bias error (MBE) and the coefficient of variation of the root mean squared error (CVRMSE) defined in ASHRAE Guideline 14-2002.

TABLE 1

| Comparison item (Prediction target) | MBE | CVRMSE |
|---|---|---|
| Cooling energy consumption (heat source: electricity) | 0.2 | 9.7 |
| Cooling energy consumption (heat source: district cooling) | 0.4 | 14.4 |
| Cooling energy consumption (heat source: gas) | 0.2 | 12.3 |
| Cooling pump energy consumption (heat source: electricity) | 0.3 | 9.4 |
| Heating energy consumption (heat source: electricity) | 0.2 | 10.2 |
| Heating energy consumption (heat source: district cooling) | 0.5 | 13.1 |
| Heating energy consumption (heat source: gas) | 0.3 | 13.6 |
| Heating pump energy consumption (heat source: electricity) | 0.4 | 12.3 |
| Hot water supply energy consumption (heat source: gas) | 0.1 | 0.8 |
| Hot water supply energy consumption (heat source: district heating) | 0.0 | 0.7 |
| Hot water supply pump energy consumption (heat source: electricity) | −0.1 | 1.3 |
| Lighting energy consumption (heat source: electricity) | 0.3 | 4.1 |
| Ventilation energy consumption (heat source: electricity) | 0.3 | 9.6 |
| Electric heat pump cooling energy consumption (heat source: electricity) | 0.4 | 11.1 |
| Electric heat pump cooling energy consumption (heat source: electricity) | 0.2 | 12.1 |

<5. Profiling Algorithm>

The types of input variables used for the profiling algorithm of the BEPS may be the same as the types of input variables applied to the standard model, the Monte Carlo sampling, the pre-simulation, and the artificial neural network model. In this example, the values of input variables used for building energy performance profiling may be input and set by the user in freedom within the range of minimum and maximum.

Further, the types of output variables of the profiling algorithm of the BEPS may be as follows.

- Per-element monthly energy consumption (cooling, heating, hot water supply, lighting, ventilation)(unit: kWh)
- Per-element annual energy consumption (cooling, heating, hot water supply, lighting, ventilation)(unit: kWh)
- Per-element monthly primary energy consumption (cooling, heating, hot water supply, lighting, ventilation) (unit: kWh)
- Per-element annual primary energy consumption (cooling, heating, hot water supply, lighting, ventilation) (unit: kWh)
- Per-element monthly CO2 emission (cooling, heating, hot water supply, lighting, ventilation)(unit: kWh)
- Per-element annual CO2 emission (cooling, heating, hot water supply, lighting, ventilation)(unit: kWh)
- Per-heat source monthly energy consumption (electricity, gas, district heating, district cooling)(unit: kWh)
- Per-heat source annual energy consumption (electricity, gas, district heating, district cooling)(unit: kWh)
- Per-heat source monthly primary energy consumption (electricity, gas, district heating, district cooling)(unit: kWh)
- Per-heat source annual primary energy consumption (electricity, gas, district heating, district cooling)(unit: kWh)

Per-heat source monthly CO2 emission (electricity, gas, district heating, district cooling)(unit: kWh)
Per-heat source annual CO2 emission (electricity, gas, district heating, district cooling)(unit: kWh)
Per-device monthly energy consumption (air conditioner, refrigerator, boiler, lighting)(unit: kWh)
Per-device annual energy consumption (air conditioner, refrigerator, boiler, lighting)(unit: kWh)
Per-device monthly primary energy consumption (air conditioner, refrigerator, boiler, lighting)(unit: kWh)
Per-device annual primary energy consumption (air conditioner, refrigerator, boiler, lighting)(unit: kWh)
Per-device monthly CO2 emission (air conditioner, refrigerator, boiler, lighting)(unit: kWh)
Per-device annual CO2 emission (air conditioner, refrigerator, boiler, lighting)(unit: kWh)

The BEPS may utilize the artificial neural network model for building energy profiling. That is, when the user sets the values of input variables through an interface of the BEPS, a result of applying the values to the artificial neural network model may be output through the interface of the BEPS.

<6. Benchmarking Analysis>

The BEPS may perform a comparative evaluation with respect to all the results of the pre-simulation and the energy profiling results of a target building through benchmarking. Here, the energy profiling results of the target building may be results derived using the profiling algorithm of the BEPS. In this example, the input variables of benchmarking analysis may be as follows.

Target building annual primary energy consumption
Target building annual CO2 emission
Target building monthly cooling energy consumption
Target building monthly heating energy consumption
Target building monthly hot water supply energy consumption
Target building monthly lighting energy consumption
Target building monthly ventilation energy consumption
Target building monthly electricity energy consumption
Target building monthly gas energy consumption
Target building monthly district heating energy consumption
Target building monthly district cooling energy consumption
Target building monthly air conditioner energy consumption
Target building monthly refrigerator energy consumption
Target building monthly boiler energy consumption
Target building monthly lighting energy consumption
Pre-simulation annual primary energy consumption total
Pre-simulation annual CO2 emission total
Pre-simulation monthly cooling energy consumption total
Pre-simulation monthly heating energy consumption total
Pre-simulation monthly hot water supply energy consumption total
Pre-simulation monthly lighting energy consumption total
Pre-simulation monthly ventilation energy consumption total
Pre-simulation monthly electricity energy consumption total
Pre-simulation monthly gas energy consumption total
Pre-simulation monthly district heating energy consumption total
Pre-simulation monthly district cooling energy consumption total
Pre-simulation monthly air conditioner energy consumption total
Pre-simulation monthly refrigerator energy consumption total
Pre-simulation monthly boiler energy consumption total
Pre-simulation monthly lighting energy consumption total In addition, the output values of benchmarking analysis may be as follows.

Annual primary energy consumption benchmarking
Annual CO2 emission benchmarking
Monthly cooling energy consumption benchmarking
Monthly heating energy consumption benchmarking
Monthly hot water supply energy consumption benchmarking
Monthly lighting energy consumption benchmarking
Monthly ventilation energy consumption benchmarking
Monthly electricity energy consumption benchmarking
Monthly gas energy consumption benchmarking
Monthly district heating energy consumption benchmarking
Monthly district cooling energy consumption benchmarking
Monthly air conditioner energy consumption benchmarking
Monthly refrigerator energy consumption benchmarking
Monthly boiler energy consumption benchmarking
Monthly lighting energy consumption benchmarking Benchmarking analysis of the BEPS may be performed through a simple comparative evaluation with respect to the energy profiling results of the target building and the energy performance of a group to be compared.

<7. Energy Performance Improvement Proposal Analysis>

The energy performance improvement proposal analysis of the BEPS may be greatly divided into an automatic function and a manual function. The automatic function may comprehensively analyze the performance improvement levels by (1) analyzing the energy performance improvement levels separately for 6 proposals and (2) selecting 3 proposals with excellent energy performance improvement levels from among the 6 proposals and applying all the three proposals selected. The types of input variables used for this may be the same as the types of input variables applied to the standard model, the Monte Carlo sampling, the pre-simulation, the artificial neural network model, and the profiling algorithm. In this example, the types and the values of the 6 energy performance improvement proposals may be as follows.

Proposal1: Wall thermal insulation (0.43 W/m 2 K)
Proposal2: Window thermal insulation (0.75 W/m 2 K) & SHGC (0.45)
Proposal3: Lighting-Daylighting control (Apply)
Proposal4: Air conditioner fan efficiency (90%)
Proposal5: Cooling plant refrigerator COP (Compression: 5.5, Absorption: 1.5)
Proposal6: Heating plant boiler efficiency (95%)

Unlikely, the manual function may enable the user to directly change the values or change the type of the system with respect to the types of all input variables. Further, the manual function may provide an economic analysis function and, for this, receive, from the user, information of construction cost and energy source unit cost (electricity, gas, district heating, district cooling) of each energy performance improvement proposal.

The values of input variables of the energy performance improvement analysis function may be used identically to those applied to the profiling algorithm, and only the input variables with respect to the 6 proposals of the automatic function in the values applied to the existing profiling algorithm and the values of proposals changed directly by the user in the manual function may be changed.

Finally, the types of input variables used for energy performance improvement proposal analysis may be as follows.

Building outline: building location, year of completion

Building shape: gross floor area, number of floors, window area ratio, length-to-width ratio, azimuth Building management: heating start time, heating end time, heating setting temperature, cooling start time, cooling end time, cooling setting temperature, air supply volume Construction property: wall heat transfer rate, window heat transfer rate, window SHGC Indoor heating: room density, room thermal value, lighting thermal density, device thermal density, infiltration Air conditioner: Main type (VAV, CAV, EHP), Main fan efficiency, Main option (outdoor air cooling, heat exchanger), cooling COP (if Main type is EHP), heating COP (if Main type is EHP), Sub-type (FCU, EHP), Sub-fan efficiency, cooling COP (if Sub-type is EHP), heating COP (if Sub-type is EHP)

Cooling plant: type (compression refrigerator, absorption refrigerator (heat source: gas, district cooling), hot and cold water dispenser), cooling COP, cold water setting temperature, coolant setting temperature Heating plant: type (gas boiler, district heating), efficiency, hot water setting temperature Hot water supply plant: type (gas boiler, district heating), hot water supply setting temperature Cost of construction Energy source unit cost: electricity, gas, district heating, district cooling Among the outputs of the energy performance improvement analysis function, the automatic function may output values of input variables (current, proposal), annual per-unit area primary energy consumptions (current, proposal), energy saving rates, and annual per-unit area CO2 emissions (current, proposal), with respect to combinations of the 6 proposals and the top 3 proposals with excellent energy performance improvement effects.

Unlikely, the manual function may have the same as the types of output variables of the profiling algorithm, to which outputs of the economic analysis and the energy performance improvement rates may be added. In this example, the outputs of the economic analysis may include the following items.

Current annual energy cost [A]

ECM-applied annual energy cost [B]

Energy saving cost [C=A−B]

Initial investment cost [D]

Investment payback period [E=D/C]

In the energy performance improvement analysis function of the BEPS, an algorithm for deriving values of output variables with respect to input variables may be the same as the profiling algorithm utilizing an artificial neural network model. The other algorithm used may be a function that evaluates 6 proposals in the automatic function, selects the top 3 proposals with excellent energy saving effects, and utilizes and analyzes a combination of the proposals as a new single energy performance improvement proposal.

<8. Building Energy Efficiency Level Analysis>

The building energy efficiency level analysis of the BEPS may be automatically performed after building energy profiling is performed using an artificial neural network based profiling algorithm. Inputs used to calculate building energy efficiency levels may be annual per-unit area primary energy consumptions derived through profiling. The types and the values of input variables used to calculate per-unit area annual energy consumptions, primary energy consumptions, and CO2 emissions for each element (cooling, heating, hot water supply, lighting, ventilation), among the forms of the other building energy efficiency levels, may be the same as those of the profiling algorithm.

In addition, the output variables of building energy efficiency level analysis of the BEPS may be as follows.

Target building energy consumption 의 energy efficiency level

Target building actual energy consumption 의 energy efficiency level

Building group average energy consumption 의 energy efficiency level

Cooling energy per-unit area annual energy consumption

Heating energy per-unit area annual energy consumption

Hot water supply energy per-unit area annual energy consumption

Lighting energy per-unit area annual energy consumption

Ventilation energy per-unit area annual energy consumption

Cooling energy per-unit area annual primary energy consumption

Heating energy per-unit area annual primary energy consumption

Hot water supply energy per-unit area annual primary energy consumption

Lighting energy per-unit area annual primary energy consumption ventilation energy per-unit area annual primary energy consumption Cooling energy per-unit area annual CO2 emission Heating energy per-unit area annual CO2 emission Hot water supply energy per-unit area annual CO2 emission Lighting energy per-unit area annual CO2 emission Ventilation energy per-unit area annual CO2 emission In the building energy efficiency level analysis, the efficiency levels may be evaluated based on the annual per-unit area primary energy consumptions. The efficiency levels may be determined based on the following Table 2.

TABLE 2

| Efficiency level | Annual per-unit area primary energy consumption ($kWh/m^2/year$) |
|---|---|
| 1+++ | 0-80 |
| 1++ | 80-140 |
| 1+ | 140-200 |
| 1 | 200-260 |
| 2 | 260-320 |
| 3 | 320-380 |
| 4 | 380-450 |
| 5 | 450-520 |
| 6 | 520-610 |
| 7 | 610-700 |

In addition, the BEPS may convert monthly outputs of the profiling algorithm into annual outputs and provide the annual outputs, with respect to the results of the per-unit area annual energy consumptions, the primary energy consumptions, and the CO2 emissions for each element (cooling, heating, hot water supply, lighting, ventilation) as the outputs for the forms of the other building energy efficiency levels.

According to example embodiments, it is possible to reduce economic and time costs incurred during diagnosis and evaluation for saving the energy of existing buildings, and systematically divide operations to be performed therefor, and integrally manage input and output data for the operations.

According to example embodiments, it is possible to check and verify the results of energy diagnosis and renovation with respect to a target building through an energy improvement learning model generated by utilizing integrally managed data.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An energy improvement learning model generating method, performed by a processor, comprising:

receiving building characteristic information including construction information, facility information, an energy consumption, environment information, weather information, and occupant behavior pattern information related to an existing building;

receiving a diagnosis result including a construction state, a facility state, an energy consumption level, and energy saving schemes for the existing building determined using the received building characteristic information;

receiving a renovation result including a renovation item with respect to the existing building, an economic cost with respect to the renovation item, an energy saving rate with respect to the existing building after the renovation, and an additional energy saving scheme using the energy saving schemes related to the diagnosis result; and generating an energy improvement learning model for the existing building by learning the building characteristic information, the diagnosis result, and the renovation result.

2. The energy improvement learning model generating method of claim 1, wherein the energy improvement learning model is configured to provide statistical data related to an energy consumption of a target building requiring energy efficiency improvement based on building characteristic information related to the target building.

3. The energy improvement learning model generating method of claim 2, wherein the energy improvement learning model is configured to derive energy saving schemes for the target building in descending order of energy saving effects based on the statistical data.

4. The energy improvement learning model generating method of claim 3, wherein the energy improvement learning model is configured to derive energy saving rates corresponding to opportunity costs of renovation using the energy saving schemes for the target building.

5. An energy improvement verification method using an energy improvement learning model, performed by a processor, comprising:

receiving building characteristic information related to a target building requiring energy efficiency improvement through a user interface;

estimating a diagnosis result for energy consumption in the form of statistical data for the target building by analyzing the received building characteristic information using the energy improvement learning model related to an existing building;

deriving energy saving schemes for the target building using the diagnosis result of the estimated energy consumption;

verifying a renovation result of the target building through some selected energy saving schemes among the derived energy saving schemes; and providing the user with the verified renovation result, wherein the energy improvement learning model is generated by learning (i) the building characteristic information related to the existing building, (ii) a diagnosis result determined using the building characteristic information, and (iii) a result of renovating the existing building using energy saving schemes related to the diagnosis result.

6. The energy improvement verification method of claim 5, wherein the deriving comprises deriving the energy saving schemes for the target building in descending order of energy saving effects based on the statistical data.

7. The energy improvement verification method of claim 6, wherein the verifying comprises verifying the renovation result of the target building by selecting an energy saving scheme higher than a preset standard from among the derived energy saving schemes.

8. The energy improvement verification method of claim 5, wherein the verifying comprises deriving energy saving rates corresponding to opportunity costs of renovation using the energy saving schemes for the target building.

9. An energy improvement verification system comprising:

an energy improvement learning apparatus configured to generate an energy improvement learning model for an existing building constructed in the past, based on (i) building characteristic information including construction information, facility information, an energy consumption, environment information, weather information, and occupant behavior pattern information related to the existing building, (ii) a diagnosis result including a construction state, a facility state, an energy consumption level, and energy saving schemes for the existing building determined using the received building characteristic information, and (iii) a renovation result including a renovation item with respect to the existing building, an economic cost with respect to the renovation item, an energy saving rate with respect to the existing building after the renovation, and an additional energy saving scheme using energy saving schemes related to the diagnosis result; and an energy improvement verification apparatus configured to receive building characteristic information related to a target building requiring energy efficiency improvement through a user interface, to estimate a diagnosis result for energy consumption in the form of statistical data for the target building by analyzing the received building characteristic information using an energy improvement learning model related to an existing building, to derive energy saving schemes for the target building using the diagnosis result of the estimated energy consumption, and to verify a renovation result of the target building through some selected energy saving schemes among the derived energy saving schemes.

10. The energy improvement verification system of claim 9, wherein the energy improvement verification apparatus is configured to derive the energy saving schemes for the target building in descending order of energy saving effects based on the statistical data.

11. The energy improvement verification system of claim 10, wherein the energy improvement verification apparatus is configured to verify the renovation result of the target building by selecting an energy saving scheme higher than a preset standard from among the derived energy saving schemes.

12. The energy improvement verification system of claim 9, wherein the energy improvement verification apparatus is configured to derive energy saving rates corresponding to opportunity costs of renovation using the energy saving schemes for the target building.

* * * * *